US009068144B2

(12) United States Patent
Trass

(10) Patent No.: US 9,068,144 B2
(45) Date of Patent: Jun. 30, 2015

(54) PROCESS FOR EXTRACTING SEED OIL COMPRISING GRINDING SEEDS IN A SOLVENT

(76) Inventor: Olev Trass, Toronto (CA)

( * ) Notice: Subject to any disclaimer, the term of this patent is extended or adjusted under 35 U.S.C. 154(b) by 290 days.

(21) Appl. No.: 13/639,137

(22) PCT Filed: Apr. 13, 2011

(86) PCT No.: PCT/CA2011/000400

§ 371 (c)(1),
(2), (4) Date: Oct. 3, 2012

(87) PCT Pub. No.: WO2011/127570

PCT Pub. Date: Oct. 20, 2011

(65) Prior Publication Data

US 2013/0030196 A1 Jan. 31, 2013

Related U.S. Application Data

(60) Provisional application No. 61/323,923, filed on Apr. 14, 2010.

(51) Int. Cl.
*C11B 1/00* (2006.01)
*C11B 1/10* (2006.01)

(52) U.S. Cl.
CPC .. *C11B 1/10* (2013.01); *C11B 1/102* (2013.01)

(58) Field of Classification Search
CPC ..... C11B 1/06; C11B 1/10
USPC ..... 554/9, 12
See application file for complete search history.

(56) References Cited

U.S. PATENT DOCUMENTS 4,730,787 A 3/1988 Trass
5,516,923 A 5/1996 Hebert et al.

OTHER PUBLICATIONS

Diosady, L.L.; Rubin, 1..1.; Trass, O. "Solvent Grinding and Extraction of Rapeseed", Proc. 6th World Rapeseed Congress, Paris, France, May, 1460-1465 ( 1983).*
Diosady, L.L.; Rubin, L.1. ; Tar, C.G.; Etkin, 8. "Air Classification of Rapeseed Meal Using the Tend Separator" Canadian Jouma[ of Chemical Engineering, vol. 64 , Oct. 1986, pp. 768-774.*
D1—Diosady Solvent Grinding and Extraction of Rapeseed.
D2—Diosady Semi Pilot Scale Solvent Grinding.
D3—Diosady Air Classification of Rapeseed.
Thesis—Adu—Peasah—1990.
D4—Two-Phase Solvent Extraction of Canola.
ManufactureOfCookingOlisAndMargine#2.
RapidExtractionOfCanolaOil—Diosady.

* cited by examiner

*Primary Examiner* — Deborah D Carr
(74) *Attorney, Agent, or Firm* — Bereskin & Parr LLP S.E.N.C.R.L., s.r.l.

(57) ABSTRACT

A process for extracting seed-oil from an oil-containing seed product comprises (a) providing the seed product to a grinder; (b) providing a first liquid comprising a solvent to the grinder; (c) grinding the seed product and the first liquid to yield a slurry; (d) subjecting the slurry to a slurry extraction and slurry separation step to yield a processed seed product and a liquid product comprising seed-oil and solvent; and (e) subjecting the liquid product to an oil separation step to at least partially separate the seed-oil from the solvent.

29 Claims, 2 Drawing Sheets

PROCESS FOR EXTRACTING SEED OIL COMPRISING GRINDING SEEDS IN A SOLVENT

FIELD

Figure 1:
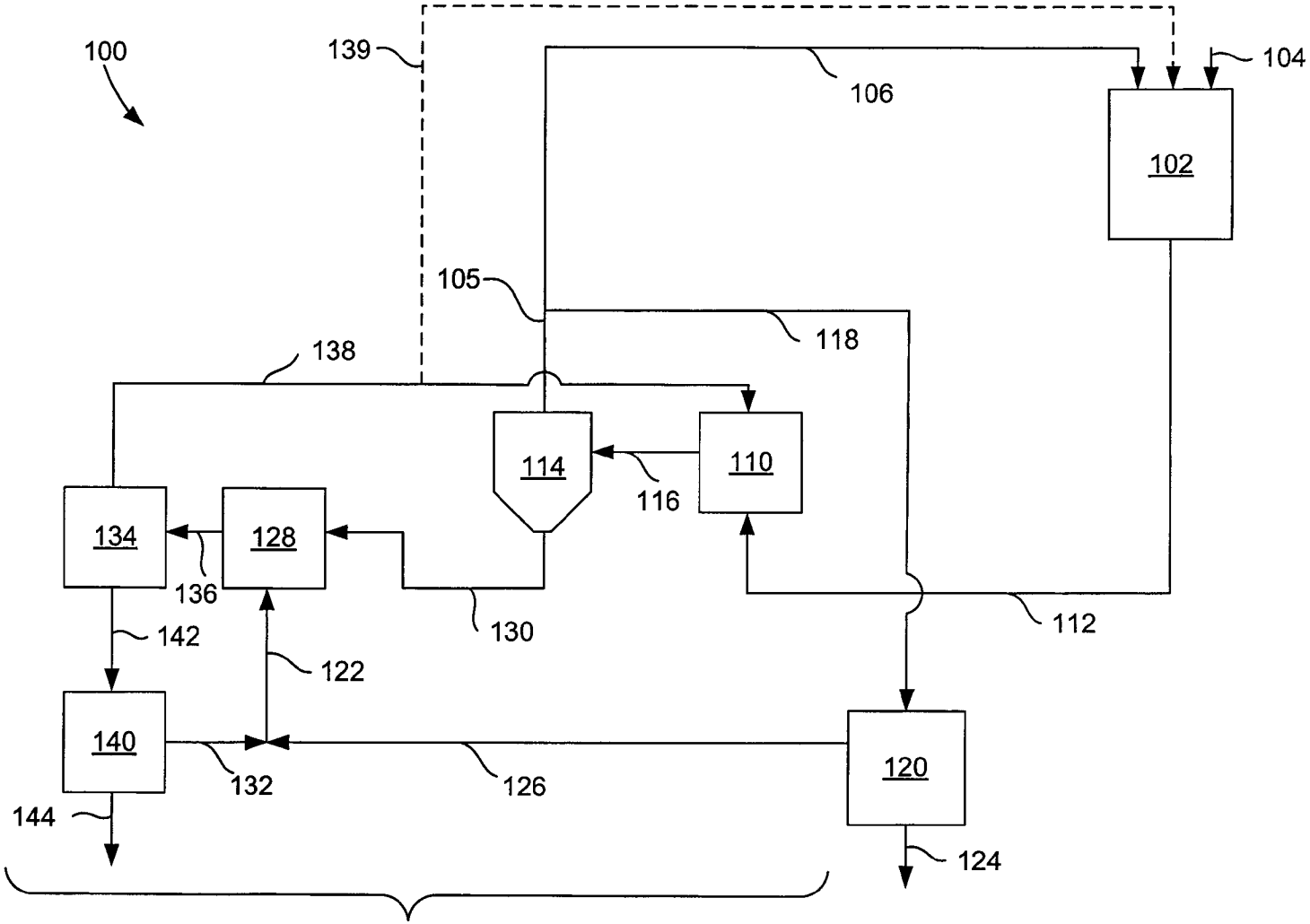

The disclosure relates to processes for extracting seed-oil, such as rapeseed oil, from an oil-containing seed product, such as rapeseeds.

SUMMARY

The following summary is provided to introduce the reader to the more detailed discussion to follow. The summary is not intended to limit the claims.

According to one aspect, a process for extracting seed-oil from an oil-containing seed product comprises (a) providing the seed product to a grinder; (b) providing a first liquid comprising hexane to the grinder; (c) grinding the seed product and the first liquid to yield a slurry; (d) subjecting the slurry to a slurry extraction and slurry separation step to yield a processed seed product and a liquid product comprising seed-oil and solvent; and (e) subjecting the liquid product to an oil separation step to at least partially separate the seed-oil from the hexane. The term "hexane" is used in this description and claims to include not only pure hexane but also other hexane-containing products. One such example is commonly referred to as food grade hexane (see IS 3470-2002).

The grinder may be a Szego Mill™.

Step (d) may comprise mixing the slurry with a feed liquid comprising hexane to yield a secondary slurry, and processing the secondary slurry in a hydrocyclone to yield the liquid product and an outlet slurry.

Step (d) may comprise a multi-stage step. In each stage, a stage feed slurry may be mixed with a stage feed liquid to yield a stage secondary slurry. The stage feed liquid may comprise seed-oil and hexane. The stage secondary slurry may be processed in a hydrocyclone to yield a stage outlet liquid comprising seed-oil and hexane and a stage outlet slurry comprising ground seed. At least a portion of the stage outlet slurry of at least one stage may be forwarded to a downstream stage. At least a portion of the stage outlet liquid of at least one stage may be recycled to an upstream stage.

When step (d) is a multi-stage step, step (d) may further comprise further processing a stage outlet slurry from a final one of the stages to yield the processed seed product, and removing at least a portion of the stage outlet liquid from one of the stages to provide the liquid product. The portion of the stage outlet liquid may be removed from a first one of the stages. The further processing may comprise mixing the stage outlet slurry with fresh hexane to yield a final slurry, decanting the final slurry to yield a wet seed product, and drying the wet seed product to yield the processed seed product. At least a portion of the fresh hexane may be obtained from the oil separation step.

A stage outlet liquid from a first one of the stages may be recycled to the grinder to provide at least a portion of the first liquid.

The oil separation step may comprise distilling the liquid product to yield seed-oil and hexane.

According to another aspect, another process for extracting seed-oil from an oil-containing seed product comprises (a) providing the seed product to a grinder; (b) providing a first liquid comprising a solvent to the grinder; (c) grinding the seed product and the liquid to yield a slurry; (d) subjecting the slurry to a slurry extraction and slurry separation step to yield a processed seed product and a liquid product comprising seed-oil and solvent; and (e) subjecting at least a first portion of the liquid product to an oil separation step to separate the seed-oil from the solvent. Step (b) comprises recycling at least a second portion of the liquid product to the grinder.

The grinder may be a Szego mill.

Step (d) may comprise mixing the slurry with a feed liquid comprising the solvent to yield a secondary slurry, and processing the secondary slurry in a hydrocyclone to yield the liquid product and an outlet slurry.

Step (d) may comprise a multi-stage step. In each stage, a stage feed slurry may be mixed with a stage feed liquid to yield a stage secondary slurry. The stage feed liquid may comprise seed-oil and solvent. The stage secondary slurry may be processed in a hydrocyclone to yield a stage outlet liquid comprising seed-oil and solvent, and a stage outlet slurry comprising ground seed. At least a portion of the stage outlet slurry of at least one stage may be forwarded to a downstream stage, and at least a portion of the stage outlet liquid of at least one stage may be recycled to an upstream stage.

A stage outlet slurry from a final one of the stages may be further processed to yield the processed seed product, and at least a portion of the stage outlet liquid from one of the stages may be removed to provide the liquid product. The portion of the stage outlet liquid may be removed from a first one of the stages. The further processing may comprise mixing the stage outlet slurry with fresh solvent to yield a final slurry, decanting the final slurry to yield a wet seed product, and drying the wet seed product to yield the processed seed product. The fresh solvent may be obtained from the oil separation step.

The oil separation step may comprise distilling the liquid product to yield seed-oil and solvent.

The solvent may be hexane.

According to another aspect, another process for extracting seed-oil from an oil-containing seed product comprises (a) providing the seed product to a grinder; (b) providing a first liquid comprising solvent to the grinder; (c) grinding the seed product and the liquid to yield a slurry; and (d) subjecting the slurry to a multi-stage slurry extraction and slurry separation step. In each stage a stage feed slurry is mixed with a stage feed liquid to yield a stage secondary slurry. The stage feed liquid comprises seed-oil and solvent. The stage secondary slurry is processed in a hydrocyclone to yield a stage outlet liquid comprising seed-oil and solvent and a stage outlet slurry comprising ground seed. At least a portion the stage outlet slurry of at least one stage is forwarded to a downstream stage and at least a portion of the stage outlet liquid of at least one stage is recycled to an upstream stage. The process further comprises (e) removing at least a portion of the stage outlet liquid from at least one of the stages is removed to provide a liquid product comprising seed-oil and solvent, and subjecting the liquid product to an oil separation step to at least partially separate the seed-oil from the solvent; and (f) mixing the stage outlet slurry from a final one of the stages with fresh solvent to yield a final slurry, and processing the final slurry to yield a processed seed product.

The grinder may be a Szego mill.

The portion of the stage outlet liquid may be removed from a first one of the stages.

The further processing may comprise decanting the final slurry to yield a wet seed product, and drying the wet seed product to yield the processed seed product.

The fresh solvent may be obtained from the oil separation step.

The oil separation step may comprise distilling the liquid product to yield seed-oil and solvent.

The solvent may be hexane.

According to another aspect, a process for extracting seed-oil from an oil-containing seed product comprises (a) providing the seed product to a grinder; (b) providing a first liquid comprising solvent to the grinder; (c) grinding the seed product and the liquid to yield a slurry; and (d) subjecting the slurry to a multi-stage slurry extraction and slurry separation step. In each stage, a stage feed slurry is mixed with a stage feed liquid to yield a stage secondary slurry. The stage feed liquid comprises seed-oil and solvent. The stage secondary slurry is processed in a hydrocyclone to yield a stage outlet liquid comprising seed-oil and solvent and a stage outlet slurry comprising ground seed. At least a portion the stage outlet slurry of at least one stage is forwarded to a downstream stage and at least a portion of the stage outlet liquid of at least one stage is recycled to an upstream stage. The process further comprises (e) removing at least a portion of the stage outlet liquid from a first one of the stages is to provide a liquid product comprising seed-oil and solvent, and subjecting the liquid product to an oil separation step to at least partially separate the seed-oil from the solvent; and (f) processing a stage outlet slurry from a final one of the stages to yield a processed seed product.

The grinder may be a Szego mill.

The further processing may comprise mixing the stage outlet slurry with fresh solvent to yield a final slurry, decanting the final slurry to yield a wet seed product, and drying the wet seed product to yield the processed seed product.

The fresh solvent may be obtained from the oil separation step.

The oil separation step may comprise distilling the liquid product to yield seed-oil and solvent.

The solvent may be hexane.

DRAWINGS

Figure 2:
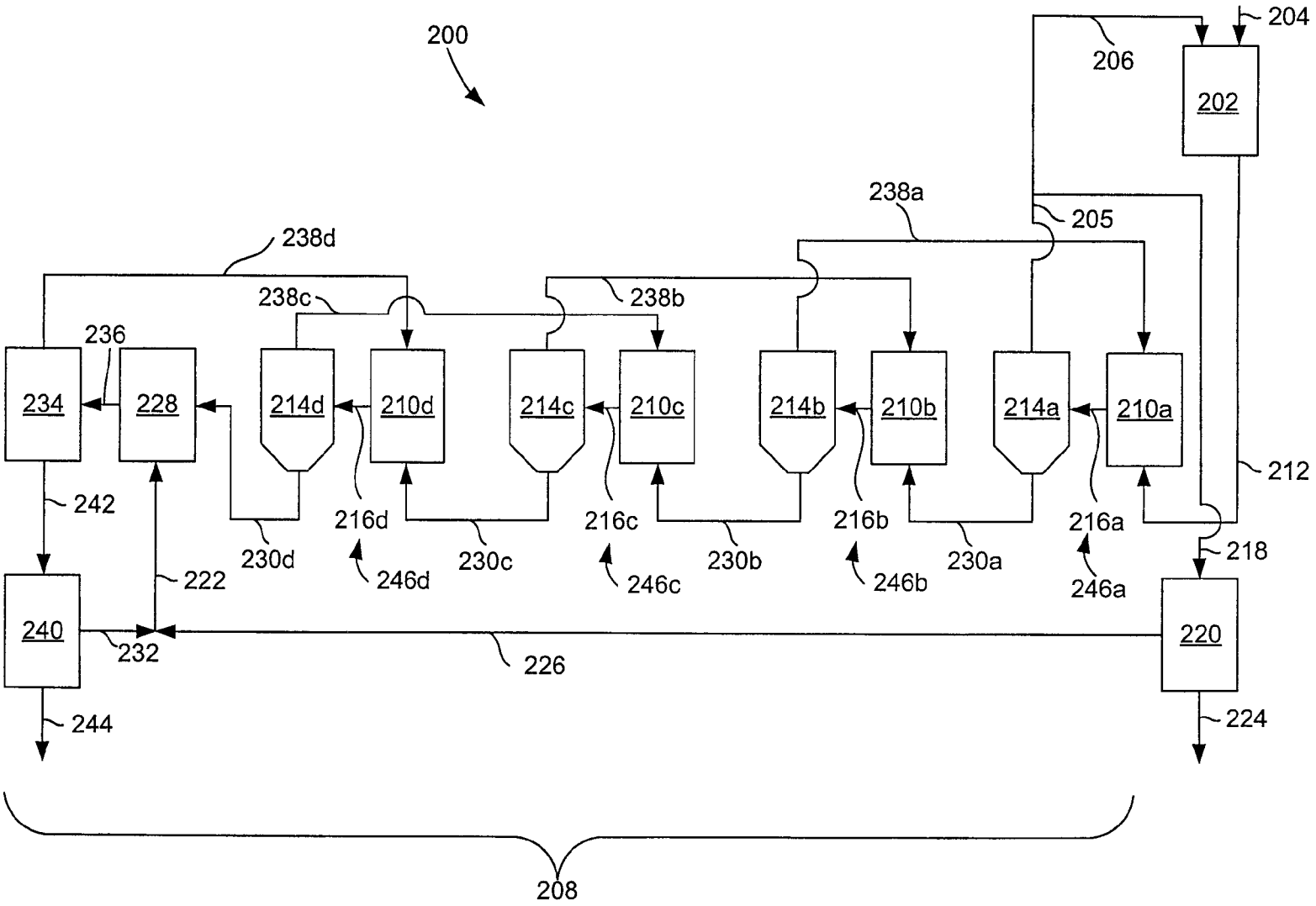

Reference is made in the detailed description to the accompanying drawings, in which:

FIG. 1 is a process flow diagram of an exemplary process for extracting seed-oil from an oil-containing seed product; and FIG. 2 is a process flow diagram of another exemplary process for extracting seed-oil from an oil-containing seed product.

DETAILED DESCRIPTION

Referring to FIG. 1, a process 100 for extracting seed-oil from an oil-containing seed product is shown. The process 100 is a continuous process, and is operated at steady state.

The oil-containing seed product may be, for example, a rapeseed product, a flaxseed product, soybean product, cottonseed product, sunflower seed product, or other suitable seed product, and the seed oil may be, for example, rapeseed oil, flaxseed oil, soybean oil, cottonseed oil, sunflower seed oil, or another oil from the suitable seed product. The seed product may include whole raw seeds. That is, the seed product does not necessarily have to be preheated, flattened, crushed, flaked, cooked, extruded, or pressed. Alternately, the seed-product may include seeds that have already undergone some processing. For example, the seed product may include seeds that have already undergone an initial process to extract some seed-oil therefrom, or the seeds may optionally be preheated, flattened, crushed, flaked, cooked, extruded, and/or pressed. The whole raw seeds may be cleaned or uncleaned, with hulls or dehulled.

Referring still to FIG. 1, the seed product is provided to a grinder 102 via line 104. Additionally, a first liquid is provided to the grinder 102 via line 106. The first liquid includes a solvent for the seed-oil. In one particular example, wherein the seed product includes cleaned rapeseed and the seed-oil is rapeseed oil, the solvent may be hexane. In alternate examples, the solvent may be an alcohol, e.g. methyl, ethyl, propyl or iso-propyl alcohol, tetrahydrofuran, petroleum ether, or other solvents in the hexane series such as butane, pentane or heptane or any mixtures of these. The first liquid may also include other components. Specifically, in the example shown, the first liquid is recycled to the grinder from a downstream step of the process, as will be described further hereinbelow, and includes some seed oil.

The ratio of the amount of seed product to the amount of the first liquid provided to the grinder may vary. For example, the ratio of the weight of seed added to the grinder to the weight of the first liquid added to the grinder may be between approximately 0.1 and 3. More specifically, the ratio may be between 0.4 and 2.

In the example shown, the grinder 102 is a Szego mill. Szego mills are known in the art, and will not be described in detail herein. For example, a Szego mill is described in U.S. Pat. No. 4,730,787 (Trass), incorporated herein by reference in its entirety. The parameters of the Szego mill may be selected such that the ground seed product has an average (or median) particle size of between approximately 150 micrometers and one millimeter, for example 300 micrometers. For example, in order to provide this particle size for a hard or tough seed product, such as flax seed, soybeans or palm kernels, heavier rollers and higher rotational speeds may be utilized. Further, the ridge-groove size ratio may be selected in order to provide a desired effective pressure acting on the particles. Further, the grooves of the Szego mill may be tapered in order to decrease the chances of particles becoming stuck in the grooves. The rotational speed of the rotor may be between 400 and 1200 rpm, which corresponds to a roller peripheral velocity of 5-14 m/s in the SM-220 mill which has an internal diameter of 220 mm. Typically, lower rotational speeds are used in larger mills so as to maintain the peripheral velocity in the same range. The average residence time in the Szego mill may be between approximately 3 and 60 seconds, for example 20 seconds.

In alternate examples, the grinder may be a ball mill, a disc mill, a roller mill, a high speed agitator or an agitated media mill.

In the grinder 102, the seed product and the first liquid are ground to yield a slurry. The slurry includes at least the solvent, seed-oil, and ground seed.

The slurry is then subjected to a slurry extraction and slurry separation step 108, to yield a processed seed product, and a liquid product including seed-oil and solvent.

In the example shown, referring still to FIG. 1, the slurry is forwarded to a mixer 110, via line 112. The mixer may be, for example, a static mixer. Alternately, the mixer may be a stirred tank. A feed liquid is also fed to the mixer 110, via line 138. The feed liquid in line 138 includes the solvent. The feed liquid may also include other components. Specifically, in the example shown, the feed liquid is recycled to the mixer via line 138 from a downstream step of the process, as will be described further hereinbelow, and includes some seed-oil in addition to the solvent. In alternate examples, the feed liquid may include only the solvent, or other additional components. In the mixer 110, the slurry is mixed with the feed liquid from line 138 to yield a secondary slurry.

The secondary slurry is then forwarded to a separator 114 via line 116. The separator may be, for example, a hydrocyclone. In alternate examples, the separator may be a screen such as a sieve-bend or a rotating sieve, or a filter system. The secondary slurry is processed in the hydrocyclone 114 to yield an outlet liquid (i.e. the overflow from the hydrocyclone), which leaves the hydrocylcone 114 via line 105, and an outlet slurry (i.e. the underflow from the hydrocyclone), which leaves the hydrocyclone via line 130. The outlet liquid in line 105 includes solvent and seed-oil. The outlet slurry in line 130 includes insoluble solids, and liquid including solvent and seed oil.

A first portion of the outlet liquid is removed from line 105 via line 118 to provide the liquid product. The liquid product is then subjected to an oil separation step to at least partially separate the seed-oil from the solvent. In the example shown, the liquid product is forwarded to a distillation column 120 via line 118, and the oil separation step includes distilling the liquid product to yield seed-oil and solvent. In alternate examples, the oil separation step may include use of an evaporator.

The seed-oil product is removed from the distillation column 120 via line 124, and may then optionally be further processed, such as by oil refining, and used or sold. The solvent leaving distillation column 120, which may also be referred to as "fresh solvent" as it is essentially free of seed oil, is removed from the distillation column via line 126 and is forwarded back to the slurry extraction and slurry separation step 108, as will be described below.

Referring still to FIG. 1, a second portion of the outlet liquid from line 105 is recycled back to the grinder 102 via line 106, to provide the first liquid, which is fed to the grinder 102, as mentioned hereinabove. For example, between approximately 10 vol % and 80 vol %, and more specifically between approximately 20 vol % and 50 vol %, of the outlet liquid may be recycled back to the grinder. An alternative approach is to direct some, or even all of the liquid in stream 138 to the grinder 102 (as shown by dotted line 139 in FIG. 1). Optionally, in such an embodiment, all of stream 105 could be fed directly to the distillation column 120.

Referring still to FIG. 1, the outlet slurry from separator 114 is further processed to yield the processed seed product. Specifically, the outlet slurry from separator 114 is forwarded to a final mixer 128 via line 130, where it is mixed with fresh solvent from line 122 to yield a final slurry. A first portion of the fresh solvent is provided via line 126 from the distillation column 120. A second portion of the fresh solvent is provided via line 132 from a further downstream drying step, as will be described below. The total amount of fresh solvent provided to the final mixer 128 may vary. For example, the ratio of the weight of fresh solvent provided to the final mixer to the weight of seed product provided to the grinder may be between 10 and 1, more specifically between 4 and 1.5.

The final slurry formed in mixer 128 is forwarded to a final separator 134 via line 136, where the solids are separated from the liquids to yield a wet seed product, and a final liquid. In the example shown, the final separator 134 is a decanter. In alternate examples, the final separator may also be a hydrocyclone, a screen, or a filter.

The final liquid is recycled upstream to the mixer 110 via line 138 to provide the feed liquid to mixer 110.

The wet seed product from separator 134 is forwarded to a drying unit 140 via line 142. In the drying unit 140, the wet seed product is dried to yield the processed seed product and fresh solvent. The drying unit may be any suitable drying unit. For example, the wet seed product may be conveyed in a jacketed screw conveyor, and hot gas may be passed over the wet seed product, in a counter-current or co-current fashion. From the screw conveyor, the moist seed product may be transferred to a fluidized bed where it will be dried completely. In order to prevent denaturation of any proteins in the wet seed product, the drying step may be carried out at temperatures less than 60-70 degrees Celsius. If it is desired to remove seed hulls, this could be readily done by adjusting the fluidizing velocity so that the small, flaky hull particles would be carried out from the fluidized bed and would then be separated from the gas stream prior to sending it to the condensor for solvent recovery. The hulls may be removed at the beginning of the process, as part of seed preparation.

Solvent that has evaporated from the wet seed product may then be condensed and forwarded to the final mixer 128 via line 132 to provide the second portion of the fresh solvent in line 122. Optionally, the condensation may be carried out under an inert gas, such as nitrogen.

The processed seed product may be removed via line 144. Optionally, if the hulls of the processed seed product retain any residual solvent, the processed seed product may be dehulled. The processed seed product may optionally be utilized or sold as meal, or further processed, for example to extract the protein therefrom.

As mentioned hereinabove, the process 100 is a continuous process operated at steady state. In general, when operating at steady state, the oil-containing seed product is fed to the process 100, and seed-oil and the processed seed product is produced. However, it will be appreciated that some solvent may be lost in the process. For example, as mentioned above, the hulls of the processed seed product may retain some residual solvent. In order to make up for losses, make-up solvent may be added to the process during operation. For example, make-up solvent may be added to the grinder 102, to the mixer 110, and/or, preferably, to the mixer 128. Furthermore, during start-up, solvent may also be added to the process. For example it may be added directly to the grinder 102, to the mixer 110, and/or to the mixer 128.

In the example of FIG. 1, the slurry extraction and slurry separation step 108 includes only a single mixer 110 and hydrocyclone 114 combination. That is, the slurry extraction and slurry separation step 108 is a single stage step. In alternate examples, a slurry extraction and slurry separation step may be a multi-stage step. The multi-stage step may include multiple stages, and each stage may include a mixer and a hydrocyclone. For example, the multi-stage step may include two to 9 stages. In each stage of the multi-stage step, a stage feed slurry may be mixed with a stage feed liquid including seed-oil and solvent to yield a stage secondary slurry. The stage secondary slurry may be processed in a hydrocyclone to yield a stage outlet liquid including seed-oil and solvent and a stage outlet slurry including ground seed. At least a portion of the stage outlet slurry of at least one stage may be forwarded to a downstream stage and at least a portion of the stage outlet liquid of at least one stage may be recycled to an upstream stage.

For example, referring now to FIG. 2, another exemplary process 200 for extracting seed-oil from an oil-containing seed product is shown. In FIG. 2, like numerals are used to refer to like elements as in FIG. 1, with the first digit incremented to 2. The process 200 of FIG. 2 is similar to the process 100 of FIG. 1, however in the process 200, the slurry extraction and slurry separation step 208 includes a multi-stage step. Specifically, the multi-stage step includes four stages, including a first stage 246*a*, a second stage 246*b*, a third stage 246*c*, and a fourth stage 246*d*.

Referring still to FIG. 2, the exemplary multi-stage slurry extraction and slurry separation step 208 will be described in detail. The slurry from the grinder 202 is forwarded to a mixer 210*a* of the first stage 246*a* via line 212. In the mixer 210*a*, the slurry is mixed with a first stage feed liquid including the solvent to yield a first stage secondary slurry. The first stage feed liquid is provided to the mixer from the second stage 246*b*, which is downstream of the first stage 246*a*, via line 238*a*, as will be described below. The first stage feed liquid may also include other components. Specifically, in the example shown, as the first stage feed liquid is recycled to the mixer 210*a* from a downstream step of the process, the first stage feed liquid includes some seed oil in addition to the solvent. In alternate examples, the first stage feed liquid may include only the solvent, or other additional components.

The first stage secondary slurry is then forwarded to a separator 214*a* of the first stage 246*a* via line 216*a*. The separator may be, for example, a hydrocyclone. The first stage secondary slurry is processed in the hydrocyclone to yield a first stage outlet liquid, which leaves the separator 214*a* via line 205, and a first stage outlet slurry, which leaves the separator 214*a* via line 230*a*. The first stage outlet liquid includes solvent and seed-oil. The first stage outlet slurry includes insoluble solids, and liquid including solvent and seed oil.

A first portion of the first stage outlet liquid in line 205 is removed via line 218 to provide the liquid product. The liquid product is then subjected to an oil separation step, as described hereinabove with respect to FIG. 1, to at least partially separate the seed-oil from the solvent. In the example shown, the liquid product is forwarded to a distillation column 220 via line 218, and the oil separation step includes distilling the liquid product to yield a seed-oil product and solvent.

The seed-oil product is removed from the distillation column 220 via line 224, and may then optionally be further processed and used or sold. The solvent, which may also be referred to as "fresh solvent" as it is essentially free of seed oil, is removed from the distillation column via line 226 and is forwarded back to the multi-stage slurry extraction and slurry separation step 208, as will be described below.

A second portion of the first stage outlet liquid in line 205 is recycled back to the grinder 202 via line 206, to provide the first liquid, as mentioned hereinabove. For example, between approximately 10 vol % and 80 vol %, and more specifically between approximately 20 vol % and 50 vol %, of the stage outlet liquid may be recycled back to the grinder 102. Alternatively, as mentioned hereinabove with respect to FIG. 1, some or all or all of the liquid in stream 238*b* may be fed to the grinder 202. Optionally, in such an embodiment, all of stream 205 could be fed directly to the distillation column 220.

The first stage outlet slurry from the separator 214*a* is forwarded downstream, to a mixer 210*b* of the second stage 246*b* of the multi-stage slurry extraction and slurry separation step 208, via line 230*a*. In the mixer 210*b*, the first stage outlet slurry from line 230*a* is mixed with a second stage feed liquid including the solvent to yield a second stage secondary slurry. The second stage feed liquid is provided to the mixer 210*b* from the third stage 246*c*, which is downstream of the second stage 246*b*, via line 238*b*, as will be described below. The second stage feed liquid may also include other components. Specifically, in the example shown, as the second stage feed liquid is recycled to the mixer 210*b* from a downstream stage of the process, the second stage feed liquid includes some seed oil in addition to the solvent. In alternate examples, the second stage feed liquid may include only the solvent, or other additional components.

The second stage secondary slurry in separator 210*b* is then forwarded to a separator 214*b* of the second stage 246*b* via line 216*b*. The second stage secondary slurry is processed in the separator 214*b* to yield a second stage outlet liquid, which leaves the separator 214*b* in line 238*a*, and a second stage outlet slurry, which leaves the separator in line 230*b*. The second stage outlet liquid in line 238*a* includes solvent and seed-oil. The second stage outlet slurry in line 230*b* includes insoluble solids, and liquid including solvent and seed oil.

The second stage outlet liquid is recycled upstream to the mixer 210*a* of the first stage 246*a*, via line 238*a*, to provide the first stage feed liquid to the mixer 210*a*. The second stage outlet slurry is forwarded downstream to a mixer 210*c* of the third stage 246*c*, via line 230*b*.

In the mixer 210*c* of the third stage 246*c*, the second stage outlet slurry from line 230*b* is mixed with a third stage feed liquid including the solvent to yield a third stage secondary slurry. The third stage feed liquid is provided to the mixer 210*c* from the fourth stage 246*d*, which is downstream of the third stage 246*c*, via line 238*c*, as will be described below. The third stage feed liquid in line 238*c* may also include other components. Specifically, in the example shown, as the third stage feed liquid is recycled to the mixer 210*c* from a downstream stage of the process, the third stage feed liquid includes some seed oil in addition to solvent. In alternate examples, the third stage feed liquid may include only the solvent, or other additional components.

The third stage secondary slurry from mixer 210*c* is then forwarded to a separator 214*c* of the third stage 246*c* via line 216*c*. The third stage secondary slurry is processed in the separator 214*c* to yield a third stage outlet liquid, which leaves the separator 214*c* in line 238*b*, and a third stage outlet slurry, which leaves the separator 214*c* in line 230*c*. The third stage outlet liquid in line 238*b* includes solvent and seed-oil. The third stage outlet slurry in line 230*c* includes insoluble solids, and liquid including solvent and seed oil.

The third stage outlet liquid is recycled upstream to the mixer 210*b* of the second stage 246*b*, via line 238*b*, to provide the second stage feed liquid to mixer 210*b*. The third stage outlet slurry is forwarded downstream to a mixer 210*d* of the fourth stage 246*d*, via line 230*c*.

In the mixer 210*d* of the fourth stage 246*d*, the third stage outlet slurry from line 230*c* is mixed with a fourth stage feed liquid including the solvent to yield a fourth stage secondary slurry. The fourth stage feed liquid is provided to the mixer 210*d* from a downstream processing step via line 238*d*, which will be described below. The fourth stage feed liquid in line 238*d* may also include other components. Specifically, in the example shown, as the fourth stage feed liquid is recycled to the mixer 210*d* from a downstream step of the process, the fourth stage feed liquid includes some seed oil in addition to the solvent. In alternate examples, the fourth stage feed liquid may include only the solvent, or other additional components.

The fourth stage secondary slurry from mixer 210*d* is then forwarded to a separator 214*d* of the fourth stage 246*d* via line 216*d*. The fourth stage secondary slurry is processed in the separator 214*d* to yield a fourth stage outlet liquid, which leaves the separator 214*d* in line 238*c*, and a fourth stage outlet slurry, which leaves the separator 214*d* in line 230*d*. The fourth stage outlet liquid in line 238*d* includes solvent and seed-oil. The fourth stage outlet slurry in line 230*d* includes insoluble solids, and liquid including solvent and seed oil.

The fourth stage outlet liquid is recycled upstream to the mixer 210*c* of the third stage 246*c*, via line 238*c*, to provide the third stage feed liquid to the mixer 210*c*. The fourth stage outlet slurry in line 230*d* is further processed to yield the processed seed product. Specifically, the fourth stage outlet slurry in line 230*d* is forwarded to a final mixer 228 via line 230*d*, where it is mixed with fresh solvent from line 222 to yield a final slurry. A first portion of the fresh solvent in line 222 is provided via line 226 from the distillation column 220. A second portion of the fresh solvent in line 222 is provided via line 232 from a further downstream drying step, as will be described below. The total amount of fresh solvent provided to the final mixer 228 may vary. For example, the ratio of the weight of fresh solvent provided to the second mixer to the weight of seed product provided to the grinder may be between 10 and 1, more specifically between 4 and 1.5.

The final slurry is forwarded to a final separator 234 via line 236, where it the solids are separated from the liquids to yield a wet seed product, which leaves the final separator 234 in line 242, and a final liquid, which leaves the final separator 234 in line 238*d*. In the example shown, the final separator 234 is a decanter. In alternate examples, the final separator 234 may be a screen or a filter.

The final liquid from the final separator 234 is recycled upstream to the mixer 210*d* of the fourth stage 246*d* via line 238*d* to provide the fourth stage feed liquid to the mixer 210*d*.

The wet seed product from the final separator 234 is forwarded to a drying unit 240 via line 242. In the drying unit 240, the wet seed product is dried to yield the processed seed product, which leaves the drying unit via line 244, and fresh solvent, which leaves the drying unit via line 232. The drying unit 240 may be any suitable drying unit. For example, the wet seed product may be conveyed in a fluidized bed, and hot gas may be passed over the wet seed product, in a counter-current or co-current fashion. Solvent that has evaporated from the wet seed product may then be condensed to yield fresh solvent, and the fresh solvent may be forwarded to the final mixer 228 via lines 232 and 222 to provide the second portion of the fresh solvent. The processed seed product is removed via line 244, and may optionally be utilized or sold as meal.

In the process 200 of FIG. 2, a portion of the stage outlet liquid is removed from the first one of the stages (i.e. is removed from the first stage 246*a* via lines 205 and 218) to provide the liquid product, and the stage outlet slurry from a final one of the stages (i.e. stage outlet slurry in line 230*d* from the fourth stage 246*d*) is further processed to yield the processed seed product. Due to the configuration of the stages, the amount of seed-oil in each stage outlet slurry decreases, going downstream from stage to stage, so that the stage outlet slurry from the fourth stage 246*d* has the lowest amount of oil. Further, the amount of seed-oil in each stage outlet liquid increases, going upstream from stage to stage, so that the stage outlet liquid from the first stage 246*a* has the highest amount of seed-oil.

In alternate examples (not shown), however, a portion of the stage outlet liquid may be removed from any other of the stages to provide the liquid product, and a portion of the stage outlet slurry from any of the stages may be further processed to yield the processed seed product.

In a further alternate example (not shown), all or a portion of the slurry from the grinder 102 or 202 (i.e. all or a portion of the slurry in line 112 or 212) may be subject to an initial separation step, wherein before being mixed with any liquids in the mixer 110 or 210*a*, the slurry is separated (e.g. using a hydrocyclone) into a initial slurry and an initial outlet liquid. The initial outlet liquid may be forwarded to an oil separation step. The initial slurry may be forwarded downstream in the slurry extraction and slurry separation step, such as steps 108 or 208.

In any of the above processes, it is possible that some insoluble solids may be entrained in the liquid that is forwarded to the distillation unit 120 or 220 (i.e. line 118 and/or 218 may contain insoluble solids). If this happens, the resulting seed-oil product may contain solids. In order to obtain seed-oil that is relatively free of solids, a fine-tuned hydrocyclone or centrifugal separator may be provided upstream of the distillation unit 120 or 220. Any solids removed by the fine-tuned hydrocyclone or centrifugal separator may be recycled back to the slurry extraction and slurry separation step (i.e. step 108 or 208), for example to mixer 110 or 210*a*.

In another alternate example (not shown), the seed product may be ground in a first liquid that is a non-solvent for the seed-oil, and is immiscible with the solvent. For example, if the solvent is hexane, the first liquid may be water. After grinding in the water, the slurry may be forwarded to a mixer, where it is mixed with the solvent. In the slurry extraction and slurry separation step, the water will remain with the insoluble solids. The resulting processed seed product will be a wet cake or meal, which may be dried in a further drying step. In this example, a recycle line between the slurry extraction and slurry separation step and the grinder would not be provided.

In another alternate example (not shown), the seed product may be ground dry, without a first liquid. In such examples, the grinding step will result in a paste, which may be forwarded to a mixer, where it is mixed with the solvent.

In any of the above processes, the system may be enclosed to minimize solvent losses to the atmosphere.

Processes 100 and 200 are shown as continuous processes that are operated at steady state. In alternate examples, a process may be operated in a batch or semi-continuous mode.

In process 100 and 200, the slurry extraction and slurry separation steps (steps 108 and 208) involve counter current extraction. In alternate examples, the slurry extraction and slurry separation steps (steps 108 and 208) may involve co-current or cross-current extraction. For example, rather than recycling liquid upstream, such as by lines 138, or any of lines 238*d*, 238*c*, 238*b*, or 238*a*, fresh solvent may be added to each mixer or to any of the mixers.

Various apparatuses or processes are described above to provide an example of each claimed invention. No example described above limits any claimed invention and any claimed invention may cover processes or apparatuses that are not described above. The claimed inventions are not limited to apparatuses or processes having all of the features of any one apparatus or process described above or to features common to multiple or all of the apparatuses described above.

EXAMPLES

Example 1

The following table provides data for a process carried out in accordance with the process 100 of FIG. 1. The data is prophetic, and includes predicted results. The data is based on the following assumptions: (1) The process is a continuous process running at steady state; (2) the seed product is raw uncleaned rapeseed, of which 40 wt % is soluble seed-oil, and 60% is insoluble solids.

| Line of Process Flow Diagram (FIG. 1) | Total Mass Flow Rate (kg/h) | Total Liquid Flow Rate (kg/h) | Total Oil Flow Rate (either in liquid phase or trapped in solids) (kg/h) | Total Insoluble Solid Flow Rate (kg/h) |
|---|---|---|---|---|
| 104 | 100 | — | 40 | 60 |
| 106 | 90 | 90 | 20 | — |
| 112 | 190 | 130 | 60 | 60 |
| 138 | 260 | 260 | 24 | — |
| 116 | 450 | 390 | 84 | 60 |
| 130 | 190 | 130 | 28 | 60 |
| 118 | 170 | 170 | 36 | — |
| 124 | 36 | 36 | 36 | — |
| 126 | 134 | 134 | — | — |

-continued

| Line of Process Flow Diagram (FIG. 1) | Total Mass Flow Rate (kg/h) | Total Liquid Flow Rate (kg/h) | Total Oil Flow Rate (either in liquid phase or trapped in solids) (kg/h) | Total Insoluble Solid Flow Rate (kg/h) |
|---|---|---|---|---|
| 132 | 46 | 46 | — | — |
| 136 | 470 | 310 | 28 | 60 |
| 142 | 110 | 50 | 4 | 60 |
| 144 | 60 | — | 4 | 60 |

Example 2

The following table provides data for a process carried out in accordance with the process 200 of FIG. 2. The data is prophetic, and includes predicted results. The data is based on the following assumptions: (1) The process is a continuous process running at steady state; (2) the seed product is uncleaned rapeseed, of which 40 wt % is soluble seed-oil, and 60% is insoluble solids.

| Line of Process Flow Diagram (FIG. 2) | Total Mass Flow Rate (kg/h) | Total Liquid Flow Rate (kg/h) | Total Oil Flow Rate (either in liquid phase or trapped in solids) (kg/h) | Total Insoluble Solid Flow Rate (kg/h) |
|---|---|---|---|---|
| 204 | 100 | — | 40 | 60 |
| 206 | 90 | 90 | 21 | — |
| 212 | 190 | 130 | 61 | 60 |
| 238a | 260 | 260 | 30 | — |
| 216a | 450 | 390 | 91 | 60 |
| 218 | 170 | 170 | 39.5 | — |
| 224 | 39.5 | 39.5 | 39.5 | — |
| 226 | 130 | 130 | — | — |
| 230a | 190 | 130 | 30 | 60 |
| 238b | 260 | 260 | 15 | — |
| 216b | 450 | 390 | 45 | 60 |
| 230b | 190 | 130 | 15 | 60 |
| 238c | 260 | 260 | 6.5 | — |
| 216c | 450 | 390 | 21 | 60 |
| 230c | 190 | 130 | 7 | 60 |
| 238d | 260 | 260 | 2.5 | — |
| 216d | 450 | 390 | 9.5 | 60 |
| 230d | 190 | 130 | 3 | 60 |
| 232 | 50 | 50 | — | — |
| 236 | 370 | 310 | 3 | 60 |
| 242 | 110 | 50 | 0.5 | 60 |
| 244 | 60.5 | — | 0.5 | 60 |

The invention claimed is:

1. A process for extracting seed-oil from an oil-containing seed product, comprising:

a) providing the seed product to a grinder;

b) providing a first liquid comprising hexane to the grinder;

c) grinding the seed product and the first liquid to yield a slurry;

d) subjecting the slurry to a slurry extraction and slurry separation step to yield a processed seed product and a liquid product, the liquid product comprising seed-oil and hexane; and e) subjecting the liquid product to an oil separation step to at least partially separate the seed-oil from the hexane to obtain a seed-oil product;

wherein step (d) comprises mixing the slurry with a feed liquid comprising hexane to yield a secondary slurry, and processing the secondary slurry in a hydrocyclone to yield the liquid product and an outlet slurry.

2. The process of claim 1, wherein the grinder is a Szego mill.

3. The process of claim 1, wherein step (d) comprises a multi-stage step, wherein in each stage, a stage feed slurry is mixed with a stage feed liquid, the stage feed liquid comprising seed-oil and hexane, to yield a stage secondary slurry, and the stage secondary slurry is processed in a stage hydrocyclone to yield a stage outlet liquid comprising seed-oil and hexane and a stage outlet slurry comprising ground seed, and at least a portion the stage outlet slurry of at least one stage is forwarded to a downstream stage and at least a portion of the stage outlet liquid of at least one stage is recycled to an upstream stage.

4. The process of claim 3, wherein step (d) further comprises further processing a stage outlet slurry from a final one of the stages to yield the processed seed product, and removing at least a portion of the stage outlet liquid from one of the stages to provide the liquid product.

5. The process of claim 3, wherein the portion of the stage outlet liquid is removed from a first one of the stages.

6. The process of claim 3, wherein the further processing comprises mixing the stage outlet slurry with fresh hexane to yield a final slurry, decanting the final slurry to yield a wet seed product, and drying the wet seed product to yield the processed seed product.

7. The process of claim 6, wherein at least a portion of the fresh hexane is obtained from the oil separation step.

8. The process of claim 3, wherein the stage outlet liquid from a first one of the stages is recycled to the grinder to provide the first liquid.

9. The process of claim 1, wherein the oil separation step comprises distilling the liquid product to yield seed-oil and hexane.

10. A process for extracting seed-oil from an oil-containing seed product, comprising:

a) providing the seed product to a grinder;

b) providing a first liquid comprising a solvent to the grinder, and wherein the solvent is selected from the group consisting of; hexane, methyl alcohol, ethyl alcohol, propyl alcohol, iso-propyl alcohol, petroleum ether, other solvents in the hexane series, and mixtures of the foregoing;

c) grinding the seed product and the liquid to yield a slurry;

d) subjecting the slurry to a slurry extraction and slurry separation step to yield a processed seed product and a liquid product, the liquid product comprising seed-oil and the solvent; and e) subjecting at least a first portion of the liquid product to an oil separation step to separate the seed-oil from the solvent to obtain a seed-oil product;

wherein step (b) comprises recycling at least a second portion of the liquid product to the grinder.

11. The process of claim 10, wherein the grinder is a Szego mill.

12. The process of claim 10, wherein step (d) comprises mixing the slurry with a feed liquid comprising the solvent to yield a secondary slurry, and processing the secondary slurry in a hydrocyclone to yield the liquid product and an outlet slurry.

13. The process of claim 10, wherein step (d) comprises a multi-stage step, wherein in each stage, a stage feed slurry is mixed with a stage feed liquid, the stage feed liquid comprising seed-oil and solvent, to yield a stage secondary slurry, and the stage secondary slurry is processed in a hydrocyclone to yield a stage outlet liquid comprising seed-oil and solvent and a stage outlet slurry comprising ground seed, and at least a portion the stage outlet slurry of at least one stage is forwarded to a downstream stage and at least a portion of the stage outlet liquid of at least one stage is recycled to an upstream stage.

14. The process of claim 13, wherein a stage outlet slurry from a final one of the stages is further processed to yield the processed seed product, and at least a portion of the stage outlet liquid from one of the stages is removed to provide the liquid product.

15. The process of claim 13, wherein the portion of the stage outlet liquid is removed from a first one of the stages.

16. The process of claim 13, wherein the further processing comprises mixing the stage outlet slurry with fresh solvent to yield a final slurry, decanting the final slurry to yield a wet seed product, and drying the wet seed product to yield the processed seed product.

17. The process of claim 16, wherein the fresh solvent is obtained from the oil separation step.

18. The process of claim 10, wherein the oil separation step comprises distilling the liquid product to yield seed-oil and solvent.

19. The process of claim 10, wherein the solvent is hexane.

20. A process for extracting seed-oil from an oil-containing seed product, comprising:

a) providing the seed product to a grinder;

b) providing a first liquid comprising a solvent to the grinder, and wherein the solvent is selected from the group consisting of; hexane, methyl alcohol, ethyl alcohol, propyl alcohol, iso-propyl alcohol, petroleum ether, other solvents in the hexane series, and mixtures of the foregoing;

c) grinding the seed product and the liquid to yield a slurry;

d) subjecting the slurry to a multi-stage slurry extraction and slurry separation step wherein in each stage a stage feed slurry is mixed with a stage feed liquid, the stage feed liquid comprising seed-oil and solvent, to yield a stage secondary slurry, and the stage secondary slurry is processed in a hydrocyclone to yield a stage outlet liquid comprising seed-oil and solvent and a stage outlet slurry comprising ground seed, and at least a portion the stage outlet slurry of at least one stage is forwarded to a downstream stage and at least a portion of the stage outlet liquid of at least one stage is recycled to an upstream stage;

e) removing at least a portion of the stage outlet liquid from at least one of the stages to provide a liquid product, the liquid product comprising seed-oil and solvent, and subjecting the liquid product to an oil separation step to at least partially separate the seed-oil from the solvent to obtain a seed-oil product;

f) mixing the stage outlet slurry from a final one of the stages with fresh solvent to yield a final slurry, wherein the fresh solvent is obtained from the oil separation step, and processing the final slurry to yield a processed seed product.

21. The process of claim 20, wherein the grinder is a Szego mill.

22. The process of claim 20, wherein the portion of the stage outlet liquid is removed from a first one of the stages.

23. The process of claim 20, wherein the further processing comprises decanting the final slurry to yield a wet seed product, and drying the wet seed product to yield the processed seed product.

24. The process of claim 20, wherein the oil separation step comprises distilling the liquid product to yield seed-oil and solvent.

25. The process of claim 20, wherein the solvent is hexane.

26. A process for extracting seed-oil from an oil-containing seed product, comprising:

a) providing the seed product to a grinder;

b) providing a first liquid comprising a solvent to the grinder, and wherein the solvent is selected from the group consisting of; hexane, methyl alcohol, ethyl alcohol, propyl alcohol, iso-propyl alcohol, petroleum ether, other solvents in the hexane series, and mixtures of the foregoing;

c) grinding the seed product and the liquid to yield a slurry;

d) subjecting the slurry to a multi-stage slurry extraction and slurry separation step wherein in each stage a stage feed slurry is mixed with a stage feed liquid, the stage feed liquid comprising seed-oil and solvent, to yield a stage secondary slurry, and the stage secondary slurry is processed in a hydrocyclone to yield a stage outlet liquid comprising seed-oil and solvent and a stage outlet slurry comprising ground seed, and at least a portion the stage outlet slurry of at least one stage is forwarded to a downstream stage and at least a portion of the stage outlet liquid of at least one stage is recycled to an upstream stage;

e) removing at least a portion of the stage outlet liquid from a first one of the stages to provide a liquid product, the liquid product comprising seed-oil and solvent, and subjecting the liquid product to an oil separation step to at least partially separate the seed-oil from the solvent to obtain a seed-oil product;

f) processing a stage outlet slurry from a final one of the stages to yield a processed seed product by mixing the stage outlet slurry with fresh solvent to yield a final slurry, decanting the final slurry to yield a wet seed product, and drying the wet seed product to yield the processed seed product, wherein the fresh solvent is obtained from the oil separation step.

27. The process of claim 26, wherein the grinder is a Szego mill.

28. The process of claim 26, wherein the oil separation step comprises distilling the liquid product to yield seed-oil and solvent.

29. The process of claim 26, wherein the solvent is hexane.

* * * * *